United States Patent [19]

Tsubuko et al.

[11] 4,104,183

[45] Aug. 1, 1978

[54] LIQUID DEVELOPER FOR USE IN ELECTROSTATIC PHOTOGRAPHY COMPRISING NATURAL RESINS AND NATURAL RESIN-MODIFIED THERMOSETTING RESINS COMBINED WITH POLYMERS

[75] Inventors: Kazuo Tsubuko; Yasuo Kizu, both of Tokyo, Japan

[73] Assignee: Ricoh Co., Ltd., Tokyo, Japan

[21] Appl. No.: 751,097

[22] Filed: Dec. 16, 1976

[30] Foreign Application Priority Data

Dec. 24, 1975 [JP] Japan ..... 50-154429

[51] Int. Cl.[2] ..... G03G 9/12

[52] U.S. Cl. ..... 252/62.1 L; 96/1 LY; 260/28.5 R; 260/24; 260/25; 260/26; 260/27 R; 427/15; 427/17

[58] Field of Search ..... 252/62.1 L; 96/1 LY; 260/28.5 R, 24, 25, 26, 27 R; 427/15, 17

[56] References Cited

U.S. PATENT DOCUMENTS

| | | | |
|---|---|---|---|
| 3,503,881 | 3/1970 | Shinohara et al. | 252/62.1 L |
| 3,912,675 | 10/1975 | Hoshi et al. | 260/27 R |
| 3,990,980 | 11/1976 | Kosel | 252/62.1 L |
| 3,997,488 | 12/1976 | Tsubuko et al. | 260/28.5 R |
| 4,060,493 | 11/1977 | Tsubuko et al. | 252/62.1 L |

*Primary Examiner*—John D. Smith

*Attorney, Agent, or Firm*—Blanchard, Flynn, Thiel, Boutell & Tanis

[57] ABSTRACT

A liquid developer for use in electrostatic photography which comprises at least one kind of resin which is substantially insoluble in a carrier liquid consisting of a non-aqueous solvent with high insulating property and low dielectric constant, a polymer consisting essentially of at least one kind of monomer which can dissolve said resin and a coloring agent, each component being contained in said carrier liquid, is excellent in dispersion stability, fixability and redispersibility so that it is suitable for use in offset printing and various transfers as well.

11 Claims, No Drawings

LIQUID DEVELOPER FOR USE IN ELECTROSTATIC PHOTOGRAPHY COMPRISING NATURAL RESINS AND NATURAL RESIN-MODIFIED THERMOSETTING RESINS COMBINED WITH POLYMERS

BACKGROUND OF THE INVENTION (a) Field of the Invention

The present invention relates to a liquid developer for use in electrostatic photography which comprises a toner consisting essentially of a pigment or a dyestuff and a non-aqueous dispersion of a specific polymer, said toner being uniformly dispersed in a carrier liquid having a high insulating property and a low dielectric constant.

(b) Description of the Prior Art

Generally, liquid developers for use in electrostatic photography are prepared by dispersing a toner consisting essentially of carbon black, organic pigment or organic dyestuff and synthetic or natural resin such as acrylic resin, phenol-modified alkyd resin, rosin, synthetic rubber, etc. with the addition of a polarity controlling agent such as lecithin, metallic soap, linseed oil, higher aliphatic carboxylic acid, etc. in a carrier liquid having a high insulating property and a low dielectric constant, such as a petroleum type aliphatic hydrocarbon. Such a toner undergoes electrophoresis in response to the electric charge of an electrostatic latent image formed in the surface layer of an electrophotographic sensitive material or an electrostatic recording material in the course of development, and it fixes on the surface of said latent image and forms a copied image. The conventional liquid developers, however, have been defective in that the resin and/or the polarity controlling agent contained therein diffuse in the carrier liquid to make the polarity indistinct, resulting in an indistinct copied image due to a lowering of the concentration of the image and the fixability, an increase of stained ground, etc. Moreover, the conventional toners, once aggregated, cannot be redispersed, and therefore, reuse thereof has been difficult. Furthermore, because of these defects, the conventional liquid developers have been disqualified for use in offset printing or in transferring process such as charge transfer, pressure transfer, magnetic transfer, etc.

SUMMARY OF THE INVENTION

The present invention is intended to provide a liquid developer for use in electrostatic photography, which can eliminate the above discussed drawbacks of the conventional liquid developers and is excellent in dispersion stability, fixability and redispersibility so that it is suitable for use in offset printing and various transfers, not to mention the use in electrostatic photography.

To be precise, a liquid developer according to the present invention comprises at least one kind of resin which is substantially insoluble in a carrier liquid consisting of a non-aqueous solvent with high insulating property and low dielectric constant, a polymer consisting essentially of at least one kind of monomer which can dissolve said resin and a coloring agent, each component being contained in said carrier liquid. The wording 'substantially insoluble' herein means 'hardly soluble' or 'utterly insoluble'.

So long as the above specified ingredients are contained therein, liquid developers obtained by methods other than the method disclosed herein are included in the present invention.

However, a preferable method of preparing a liquid developer according to the present invention is to form a dispersion of such a specific polymer as above to begin with and then add pigment or dyestuff to this dispersion.

The method of preparing a dispersion of said polymer to serve as the toner of the liquid developer in the present invention is based on the art of dissolving the above mentioned resin, which is substantially insoluble in a non-aqueous solvent, in said monomer beforehand and then polymerizing said monomer. So long as this method is followed, other conditions can be modified in various ways: for instance, it is possible to effect polymerization of said monomer by adding a monomer solution obtained by dissolving the resin in the monomer to a non-aqueous solvent dropwise; and it also is possible to effect polymerization by adding some non-aqueous solvent to the monomer solution or effect polymerization directly in the absence of non-aqueous solvent and then disperse the resulting polymer in a non-aqueous solvent.

Moreover, this dispersion may contain a wax-like substance or a polyolefin having a softening point in the range of about 60°–130° C; in this case, these substances are added to the monomer solution prior to polymerization or in the course of polymerization, or to the resulting dispersion after polymerization, thereby enhancing the dispersibility.

The conditions for polymerization can be selected in various ways; in the case of polymerization by heating, it is desirable to effect it at a temperature in the range of about 70°–110° C, preferably 80°–100° C, in the presence of a conventional polymerization initiator such as benzoyl peroxide or azobisisobutyronitrile in a monomer solution or a non-aqueous solvent.

In this context, the resin which is substantially insoluble in non-aqueous solvents and the monomer, which constitute the starting materials, are used either individually or as a mixture of two or more kinds thereof, respectively.

In this way, a dispersion comprising a resin substantially insoluble in non-aqueous solvents and a polymer capable of solvation with non-aqueous solvents can be obtained. It seems that said resin contained in this dispersion acts as a dispersion stabilizer, while said polymer contained in same, although it depends on the kind and amount of the material employed and the conditions for polymerization (e.g., temperatures, stirring, cooling, etc.), acts as a dispersion stabilizer, a polarity controlling agent and a fixer concurrently. Besides, the action and effect of said resin and polymer within the liquid developer can be altered by using them jointly with the aforesaid wax-like substances or polyolefins or other monomers such as described in the following. In the case where said resin and polymer are used jointly with wax or polyolefin, these substances are separated in the form of fine particles within the polymerization system when quenched, and at the time of said separation, they are adsorbed onto said polymer and dispersed, whereby not only the dispersion stability of the toner and the redispersibility of the dispersion can be more effectively enhanced, but also it becomes possible to control the viscosity of the dispersed toner as well as the particle size of the toner, and a stable toner capable of forming an image of high contrast can be prepared.

To cite applicable resins which are substantially insoluble in non-aqueous solvents, there can be mentioned natural resins such as ester gum, hardened rosin, etc. and natural resin modified thermo-setting resins such as natural resin modified maleic resin, natural resin modified phenol resin, natural resin modified polyester resin, natural resin modified pentaerythritol resin, etc. As the commercially available resins of this kind, the following can be cited.

EXAMPLES OF NATURAL RESIN MODIFIED MALEIC RESIN

MRG, MRG-411, MRG-S, MRG-H, MRP, MRA-L, MRM-42, MRM-53 (the foregoing are manufactures of TOKUSHIMA SEIYU K.K.), BECKASITE 1110, BECKASITE 1111, BECKASITE F231, BECKASITE J811, BECKASITE 1120, BECKASITE J-896 (the foregoing are manufactures of DAINIPPON INK KAGAKU K.K.)

EXAMPLES OF NATURAL RESIN MODIFIED PHENOL RESIN

PRG, PRP, SPR-N, SPR-A, SPR-H (the foregoing are manufactures of TOKUSHIMA SEIYU K.K.), BECKASITE 1100, BECKASITE 1123, BECKASITE 1126, BECKASITE F-171 (the foregoing are manufactures of DAINIPPON INK KAGAKU K.K.)

EXAMPLES OF NATURAL RESIN MODIFIED PENTAERYTHRITOL RESIN

PENTASITE P-406, PENTASITE P-423 (both are the manufacture of DAINIPPON INK KAGAKU K.K.)

EXAMPLES OF NATURAL RESIN MODIFIED POLYESTER RESIN

RM-1000, RM-1300, RM-4090, RM-4100 (the foregoing are manufactures of TOKUSHIMA SEIYU K.K.)

EXAMPLES OF ESTER GUM

EG-800, EG-9000, HG-H, PE, PE-H (the foregoing are manufactures of TOKUSHIMA SEIYU K.K.) 6cl

EXAMPLES OF HARDENED ROSIN

TLR-21, TLR-57 (both are the manufacture of TOKUSHIMA SEIYU K.K.)

As the monomer to constitute a polymer capable of solvation with non-aqueous solvents and also capable of dissolving the aforesaid resin, there can be cited vinyl monomers expressed by the general formula

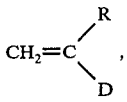

[wherein R represents —H or $CH_3$ group and D represents $—COOC_nH_{2n+1}$ or $—OC_nH_{2n+1}$ group (wherein $n$ is an integer ranging from 6 to 20 )] (hereinafter called 'monomer A') such as stearyl, lauryl, 2-ethyl hexyl or hexyl ester of acrylic acid or methacrylic acid; t-butyl methacrylate, cetyl methacrylate, octyl methacrylate; vinyl stearate, etc. (hereinafter called 'monomer A').

This monomer A can be used upon mixing with at least one member of the group consisting of glycidyl methacrylate, glycidyl acrylate, propylene glycol monoacrylate, propylene glycol methacrylate, hydroxyethyl methacrylate, acrylonitrile and methacrylonitrile (hereinafter called 'monomer B'). These monomer B's are added to monomer A before polymerization of monomer A, or added to the polymer after polymerization of monomer A, thereby to effect copolymerization. Monomer B dissolves said resins which are substantially insoluble in non-aqueous solvents, but in the case where monomer B alone is polymerized, the resulting polymer cannot be solvated with non-aqueous solvents. The appropriate mixing ratio of monomer A to monomer B is in the range of 70–99:30–1 or thereabouts (by weight).

Further, in the present invention, the monomer A or the mixture of monomer A and monomer B can be applied upon mixing with at least one member of the group consisting of acrylic acid, methacrylic acid, lower alkyl esters of these acids (having 1–4 carbon atoms), styrene, methyl styrene, vinyl toluene and vinyl acetate (hereinafter called 'monomer C'). These monomer C's are added to the mixture of monomer A and monomer B before polymerization of monomer A and monomer B or to the polymer after polymerization of monomer A and monomer B. This monomer C, like monomer B, can dissolve said resins which are substantially insoluble in non-aqueous solvents, but in the case where monomer C alone is polymerized, the resulting polymer cannot be solvated with non-aqueous solvents. In the case of joint use of monomer C, the appropriate mixing ratio of monomer A to monomer C is in the range of 50–90:50–10 or thereabouts (by weight), and the appropriate mixing ratio of monomer A:monomer B:monomer C is in the range of 60–90:20–1:20–1 or thereabouts (by weight).

The appropriate mixing ratio of a resin substantially insoluble in non-aqueous solvents to monomer A (or a mixture of monomer A and monomer B and/or monomer C) is in the range of 5–50:50–95 or thereabouts (by weight).

To cite applicable non-aqueous solvents, there are substances of the same kind as the carrier liquid, to wit, petroleum type aliphatic hydrocarbons having a high insulating property (electric resistance: more than $10^9\Omega$.cm) and a low dielectric constant (dielectric constant: less than 3) (including such commercial articles as ISOPAR E, ISOPAR G, ISOPAR L, ISOPAR H, ISOPAR K, NAPHTHA No. 6, SOLVESSO 100, etc. manufactured by EXXON Inc.), n-hexane, ligroin, n-heptane, n-pentane, isododecane, iso-octane, etc., with the addition of halogen derivatives thereof such as carbon tetrachloride, perchloroethylene, etc.

To cite applicable coloring agents, to wit, pigment or dyestuff, there are carbon black, Oil Blue, Alkali Blue, Phthalocyanine Blue, Phthalocyanine Green, Spirit Black, Oil Violet, Benzidine Yellow, Methyl Orange, Brilliant Carmine, Fast Red, Methyl Violet, etc. In this context, though the mixing ratio of polymer to coloring agent by weight is not particularly limited, the amount of the polymer is generally in the range of about 0.5–10 parts by weight based on one weight part of the pigment.

Commercially available wax-like substances or polyolefins are as follows:

| Instances of polyethylene name of maker | trade name | softening point (° C) |
|---|---|---|
| UNION CARBIDE Inc. (U.S.A.) | DYNI | 102 |

-continued

| Instances of polyethylene name of maker | trade name | softening point (° C) |
|---|---|---|
| | DYNF | 102 |
| | DYNH | 102 |
| | DYNJ | 102 |
| | DYNK | 102 |
| Monsanta Inc. (U.S.A.) | ORLIZON 805 | 116 |
| | ORLIZON 705 | 106 |
| | ORLIZON 50 | 126 |
| PHILIPS Inc. (U.S.A.) | MARLEX 1005 | 92 |
| DU PONT Inc. (U.S.A.) | ALATHON-3 | 103 |
| | ALATHON 10 | 96 |
| | ALATHON 12 | 84 |
| | ALATHON 14 | 80 |
| | ALATHON 16 | 95 |
| | ALATHON 20 | 86 |
| | ALATHON 22 | 84 |
| | ALATHON 25 | 96 |
| ALLIED CHEMICAL Inc. (U.S.A.) | AC-POLYETHYLENE 1702 | 98 |
| ALLIED CHEMICAL Inc. (U.S.A) | AC-POLYETHYLENE 6 & 6A | 102 |
| ALLIED CHEMICAL Inc. (U.S.A.) | AC-POLYETHYLENE 615 | 105 |
| SANYO KASEI K.K. | SANWAX 131-P | 108 |
| | SANWAX 151-P | 107 |
| | SANWAX 161-P | 111 |
| | SANWAX 165-P | 107 |
| | SANWAX 171-P | 105 |
| | SANWAX E-200 | 95 |

| Instances of wax (paraffin wax) name of maker | trade name | softening point (° C) |
|---|---|---|
| JUNSEI KAGAKU K.K. | PARAFFIN WAX | 60 – 98 |
| KOBAYASHI KAKO K.K. | BLEACHED BEESWAX | 65 |
| | CETANOL | 80 |
| NAGAI KAKO K.K. | BLEACHED BEESWAX | 65 |
| SEITETSU KAGAKU K.K. | FLOHSEN | 110 |

Hereunder will be given instances of manufacture of the polymer dispersion for use in the present invention.

Instance of manufacture-1

300 g of ISOPAR H were put in a three-nozzle receptacle equipped with a stirrer, a thermometer and a reflux condenser, having a capacity of 1.6 l, and heated up to 90° C. Meanwhile, 80 g of BECKASITE F-171 were dissolved in 200 g of 2-ethyl hexyl methacrylate, and further 2 g of azobisisobutyronitrile were mixed with the resulting solution. The thus obtained mixture was put in the foregoing receptacle dropwise over 4 hours' period to effect polymerization, and after further stirring for 1 hour thereafter, a polymer dispersion containing 48.3% of solid matter was prepared.

Instance of manufacture-2

300 g of iso-octane were put in the same receptacle as used in Instance-1 and heated up to 90° C. Meanwhile, 50 g of BECKASITE J811 were dissolved in 205 g of stearyl methacrylate and then 2 g of benzoyl peroxide were mixed with the resulting solution. Subsequently, the thus obtained mixture was put in the foregoing receptacle dropwise over 2.5 hours' period to effect polymerization, and after heating for about 11 hours thereafter, a polymer dispersion containing 46.8% of solid matter was prepared.

Instance of manufacture-3

400 g of ISOPAR L were put in the same receptacle as used in Instance-1, and heated up to 90° C. Meanwhile, 80 g of PENTASITE P-406 were dissolved in a blended monomer consisting of 18 g of glycidyl methacrylate and 100 g of lauryl methacrylate and then 2 g of benzoyl peroxide were mixed with the resulting solution. Subsequently, the thus obtained mixture was put in the foregoing receptacle dropwise over 4 hours' period to effect polymerization, whereby a polymer dispersion containing 40% of solid matter was prepared.

Instance of manufacture-4

Through the same procedure as in Instance-1 save for dissolving 25 g of ORLIZON 705 in 300 g of ISOPAR H and quenching the receptacle (heated up to 90° C) with cooling water upon completion of the polymerization, a polyethylene-containing polymer dispersion having 47.1% of solid content was prepared.

Instance of manufacture-5

Through the same procedure as in Instance-1 save for adding paraffin wax having a softening point of 80° C to the polymerization system at the time of completion of the polymerization, dissolving it by heating up to 90° C, stirring thoroughly, and quenching the receptacle with tap water, a paraffin wax-containing polymer dispersion having 35% of solid content was prepared.

Instance of manufacture-6

300 g of iso-octane were put in the same receptacle as used in Instance-1, and heated up to 90° C. Meanwhile, 100 g of BECKASITE J896 were dissolved in a blended monomer consisting of 200 g of 2-ethyl hexyl methacrylate and 10 g of glycidyl methacrylate and 10 g of glycidyl methacrylate and then 2 g of benzoyl peroxide were mixed with the resulting solution. Subsequently, by putting the thus obtained mixture in the foregoing receptacle dropwise over 3 hours' period to effect polymerization, maintaining the receptacle at the foregoing temperature for 3 hours in order to complete the reaction and then adding 1 g of lauryl dimethacrylate and 3 g of methacrylic acid thereto, 18 hours' reaction at 90° C was effected. Next, after adding 500 g of iso-octane to this reaction system, by further adding thereto a mixture consisting of 50 g of methyl methacrylate and 3 g of benzoyl peroxide dropwise over 3 hours' period and effecting 5 hours' reaction in succession, a polymer dispersion was prepared.

Instance of manufacture-7

Through the same procedure as in Instance-6 save for further adding 30 g of SANWAX 131-P to 500 g of iso-octane and quenching the receptacle (heated up to 90° C) with tap water after the reaction, a polyethylene-containing polymer dispersion was prepared.

Instance of manufacture-8

300 g of ISOPAR G were put in the same receptacle as used in Instance-1, and heated up to 90° C. Meanwhile, 50 g of PENTASITE P-423 were dissolved in 200 g of stearyl methacrylate. By putting the resulting solution in the foregoing receptacle dropwise over 4 hours' period, effecting reaction for 15 hours at 90° C in succession, adding 500 g of ISOPAR G thereafter, and further adding a mixture consisting of 50 g of methyl methacrylate and 4 g of azobisisobutyronitrile dropwise over 3 hours' period at 90° C thereby completing the reaction, a polymer dispersion containing 28.4% of solid matter was prepared.

Instance of manufacture-9

Through the same procedure as in Instance-8 save for adding 30 g of SANWAX 165-P to 300 g of ISOPAR G, a polyethylene-containing polymer dispersion was prepared.

Instance of manufacture-10

Through the same procedure as in Instance-8 save for omission of 50 g of methyl methacrylate in effecting the reaction, a polymer dispersion was prepared.

Instance of manufacture-11

Upon putting 70 g of lauryl methacrylate and 10 g of glycidyl methacrylate in the same receptacle as used in Instance-1, 20 g of BECKASITE (F-231) were dissolved therein. After heating the resulting solution up to 90° C, by adding 1.5 g of benzoyl peroxide and effecting 8 hours' polymerization, and thereafter adding 100 g of ISOPAR H, a polymer dispersion containing 50% of solid matter was prepared.

Instance of manufacture-12

By adding 15 g of methacrylic acid to 200 g of the polymer obtained in Instance-11 and effecting polymerization for 15 hours at 90° C, a polymer dispersion containing 54% of solid matter was prepared.

Instance of manufacture-13

After adding 200 g of ISOPAR H to 200 g of the polymer obtained in Instance-12 and heating the mixture up to 90° C, by adding 50 g of a low molecular weight polyethylene (namely, SANWAX 171-P) to dissolve therein and quenching with tap water thereafter, a polymer dispersion containing 31% of solid matter was prepared.

Instance of manufacture-14

Through the same procedure as in Instance-12 save for omission of 12 g of methacrylic acid, a polymer dispersion containing 48% of solid matter was prepared.

The polymer dispersions obtained through the foregoing procedures have such merits as follows:

(1) The manufacturing process is simple, and the product can be stably obtained in the form of a uniform dispersion.

(2) The dispersed polymer is generally small in particle size, and is excellent in dispersion stability, polarity controllability and fixability.

In order to prepare a liquid developer according to the present invention, it will do to prepare a concentrated toner by dispersing 0.1–10 parts by weight of pigment or dyestuff relative to 1 part by weight of solid content of a polymer dispersion obtained as above together with a proper quantity of carrier liquid (which is identical with non-aqueous solvent applied) by means of a disperser such as a ball-mill and dilute said concentrated toner with a fixed quantity of carrier liquid.

A liquid developer prepared in this way has a variety of merits as follows owing to the characteristics of the foregoing polymer dispersions.

(1) Inasmuch as the carrier liquid is identical with the dispersion medium for the polymer dispersion, dispersion can be performed efficiently in a short time. Besides, in the case of diluting and dispersing the resulting concentrated toner with the carrier liquid, it can be performed rapidly without being attended with the so-called 'solvent shock'.

(2) It scarcely gives rise to separation of the polymer from the toner particles with the passage of time, and accordingly, the developer is stable for a long time.

(3) A lot of polymer adheres to the surface of particles of pigment or dyestuff while there is also free polymer within the carrier liquid, but as the polymer per se is capable of electrophoresis in response to the electric charge of electrostatic latent image and participates in forming the image, there can be found an image of good fixability.

(4) For the reason set forth in (3) above, it is suited as the developer for use in offset printing.

(5) As it is excellent in both transferability and fixability, it is suited as the developer for use in charge transfer, pressure transfer, pressure transfer, magnetic transfer, etc.

DESCRIPTION OF THE PREFERRED EMBODIMENTS

EXAMPLE 1

| | |
|---|---|
| polymer dispersion obtained in Instance of manufacture-1 (solid content: 48.3%) | 20 g |
| MITSUBISHI CARBON #44 (the manufacture of MITSUBISHI CARBON K.K.) | 2 g |
| Special Black EB (the manufacture of ORIENT KAGAKU K.K.) | 1 g |
| ISOPAR G | 100 g |

By dispersing a mixture having the above composition for 48 hours by means of a ball mill, a concentrated toner was prepared. Subsequently, by dispersing 8 g of the thus prepared toner in 2 l of ISOPAR G, a liquid developer was prepared.

When an electrostatic latent image was formed on a commercial electrophotographic copying material (to wit, a zinc oxide-resin dispersion type photosensitive material) by the conventional method and this latent image was developed with the foregoing developer, there was obtained a copy carrying an image having a concentration of 1.25 and fixability superior to that in the prior art. When the present developer was subjected to 7 days' forced deterioration test at 50° C to examine the stability of the toner, there was observed practically no deterioration.

Example 2

| | |
|---|---|
| polymer dispersion obtained in Instance of manufacture-2 (solid content: 46.8%) | 50 g |
| CARBON BLACK MA-100 (the manufacture of MITSUBISHI CARBON K.K.) | 10 g |
| ISOPAR H | 150 g |

By putting a mixture having the above composition in a ball mill and dispersing it for 28 hours, a concentrated toner was prepared. Subsequently, by dispersing 15 g of the thus prepared toner in 2 l of ISOPAR H, a liquid developer was prepared. When an image was formed on a commercial wet-type electrophotographic offset master by the conventional method by using this developer and said offset master was employed for printing after desensitization, there could be obtained distinct prints. Especially on the image area of the offset master, the ink was ready to stick by virtue of the superior oleophilic property of the toner, so that the image concentration of the prints was more than 1.3, and also on account of the superior fixability of the toner, printing of more than 10,000 copies was possible.

Example 3

| | |
|---|---|
| polymer dispersion obtained in Instance of manufacture-3 (solid content: 40%) | 50 g |
| tri-iron tetroxide | 10 g |
| ISOPAR G | 100 g |

By dispersing a mixture having the above composition for 48 hours by means of a ball mill, a concentrated toner was prepared. Subsequently, by dispersing 30 g of the thus prepared toner in 2 l of ISOPAR G, a liquid developer for use in magnetic transfer was prepared. When an electrostatic latent image was formed on a commercial electrophotographic sensitive material, said latent image was developed with this liquid developer, a transfer paper was laid on the thus developed sensitive material and magnetism was imparted to the sensitive material by way of the side whereon the transfer paper was laid, about 90% of the toner image was transferred to the transfer paper.

Example 4

| | |
|---|---|
| polymer dispersion obtained in Instance of manufacture-8 (solid content: 28.4%) | 40 g |
| MICROLITH BLUE (the manufacture of CIBA K.K.) | 2.0 g |
| SHELLSOL 71 (aliphatic hydrocarbon manufactured by SHELL OIL Inc.) | 100 g |
| MITSUBISHI CARBON #44 | 5.0 g |

By dispersing a mixture having the above composition for 50 hours by means of a ball mill, a concentrated toner was prepared. Subsequently, by dispersing 10 g of the thus prepared toner in 2 l of SHELLSOL 71, there was obtained a negatively charged liquid developer for use in electrostatic transferring. When an electrostatic latent image was formed on a photosensitive plate made of selenium, said latent image was developed with this liquid developer, and charge transfer to a transfer paper was conducted, the transfer ratio was about 75%. The resulting transferred image demonstrated a superb fixability and was of high contrast.

Example 5

| | |
|---|---|
| polymer dispersion obtained in Instance of manufacture-13 (solid content: 31%) | 120 g |
| MITSUBISHI CARBON #100 | 15 g |
| ISOPAR G | 1,100 g |

By dispersing a mixture having the above composition for 15 hours by means of an attriter, a concentrated toner was prepared. Subsequently, by dispersing 10 g of the thus prepared toner in 2 l of ISOPAR G, a liquid developer was prepared. When this developer was applied to developing in the preparation of an offset master employing a commercial wet-type electro-photographic sensitive material and said offset master was employed for printing after desensitization, there could be obtained more than 10,000 prints displaying a high contrast like that in Example 2.

Example 6

| | |
|---|---|
| polymer dispersion obtained in Instance of manufacture-1 (solid content: 48.3%) | 120 g |
| polyethylene-containing polymer dispersion obtained in Instance of manufacture-9 | 110 g |
| MICROLITH BLUE (the manufacture of CIBA K.K.) | 50 g |
| MICROLITH BLACK CT (the manufacture of CIBA K.K.) | 115 g |
| ISOPAR H | 1,120 g |

By dispersing a mixture having the above composition for 5 hours by means of an attriter (28 r.p.m.), a concentrated toner was prepared. Subsequently, by dispersing 10 g of the thus prepared toner in 1.5 l of ISOPAR H, a positively charged liquid developer was prepared. When an electrostatic latent image was formed on an organic semi-conductive sensitive plate, said latent image was developed with the foregoing liquid developer, and pressure transfer of the thus developed image was conducted, about 80% of the toner could be transferred to the transfer paper. The transferred image displayed image concentration of 1.2 and superb fixability.

What is claimed is:

1. A liquid developer for use in electrostatic photography consisting essentially of a toner dispersed in a carrier liquid having a high resistivity and a low dielectric constant, said toner consisting essentially of pigment or dye particles and a non-aqueous resin dispersion, said non-aqueous resin dispersion consisting essentially of a non-aqueous solvent having a high insulating property and a low dielectric constant selected from the group consisting of aliphatic hydrocarbons and halogen derivatives thereof, said solvent having dispersed therein at least one resin which is substantially insoluble in said solvent, said resin being selected from the group consisting of natural resins and natural resin-modified thermosetting resins, said solvent also having dispersed therein a polymer of at least one monomer A which has the formula

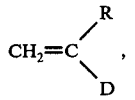

wherein R is hydrogen or $CH_3$, D is $—COOC_nH_{2n+1}$ or $—OC_nH_{2n+1}$, and $n$ is an integer ranging from 6 to 20, said monomer A being capable of dissolving said resin, the weight ratio of said resin:said polymer being in the range of from about 5–50:50–95, said polymer being solvated by said solvent.

2. A liquid developer according to claim 1, which further comprises at least one dispersant selected from the group consisting of wax and polyolefins having a softening temperature in the range of 60° - 130° C, wherein the amount of said dispersant is in the range of 10 - 50 parts by weight per 100 parts by weight of said polymer.

3. A liquid developer according to claim 1, wherein said polymer consists essentially of a homopolymer of monomer A.

4. A liquid developer according to claim 1, wherein said polymer consists essentially of a copolymer of said monomer A and at least one monomer B selected from the group consisting of glycidyl methacrylate, glycidyl acrylate, propylene glycol monoacrylate, propylene glycol methacrylate, hydroxyethyl methacrylate, acrylonitrile and methacrylonitrile, wherein the weight ratio of said monomer A to said monomer B is in the range of about 70–99:30–1.

5. A liquid developer according to claim 1, wherein said polymer consists essentially of a copolymer of said monomer A and at least one monomer C selected from the group consisting of acrylic acid, methacrylic acid, lower alkyl esters of acrylic acid and methacrylic acid in which said alkyl has 1 to 4 carbon atoms, styrene, methyl styrene, vinyl toluene and vinyl acetate, wherein the weight ratio of monomer A:monomer C is in the range of about 50–90:50–10.

6. A liquid developer according to claim 1 wherein said polymer consists essentially of a terpolymer of said monomer A, monomer B and monomer C, wherein monomer B is at least one monomer selected from the group consisting of glycidyl methacrylate, glycidyl acrylate, propylene glycol monoacrylate, propylene glycol methacrylate, hydroxyethyl methacrylate, acrylonitrile and methacrylonitrile, wherein monomer C is at least one monomer selected from the group consisting of acrylic acid, methacrylic acid, lower alkyl esters of acrylic acid and methacrylic acid in which said alkyl has 1 to 4 carbon atoms, styrene, methyl styrene, vinyl toluene and vinyl acetate, and wherein the weight ratio of monomer A:monomer B:monomer C is in the range of about 60–90:20–1:20–1.

7. A liquid developer according to claim 1 wherein said resin is selected from the group consisting of natural ester gum resins, natural hardened rosin, natural resin-modified maleic resins, natural resin-modified phenol resins, natural resin-modified polyester resins, natural resin-modified pentaerythritol resins and mixtures thereof.

8. A liquid developer according to claim 1 containing from 0.5 to 10 parts by weight of said polymer, per one part by weight of said pigment or dye particles.

9. A liquid developer according to claim 1 in which said carrier liquid and said non-aqueous solvent are the same.

10. A liquid developer according to claim 1, in which said dispersion has been prepared by dissolving said resin in said monomer A to form a solution thereof, and polymerizing said monomer in said solution, in the presence of said non-aqueous solvent.

11. A process for developing an electrostatic latent image which comprises applying to said electrostatic latent image a liquid developer as claimed in claim 1.

* * * * *